United States Patent [19]

Swann

[11] 4,145,586

[45] Mar. 20, 1979

[54] ELECTRIC SWITCHES

[76] Inventor: David A. Swann, 17-21 Carinish Rd., Clayton, Victoria, 3168, Australia

[21] Appl. No.: 752,284

[22] Filed: Dec. 20, 1976

Related U.S. Application Data

[63] Continuation of Ser. No. 634,177, Nov. 21, 1975, abandoned.

[30] Foreign Application Priority Data

Nov. 25, 1974 [AU] Australia ..... PB 9740
Dec. 3, 1974 [AU] Australia ..... PB 9857

[51] Int. Cl.[2] ..... H01H 9/18

[52] U.S. Cl. ..... 200/67 G; 200/68; 200/16 C

[58] Field of Search ..... 200/155 R, 68, 67 G, 200/63, 16 C, 16 D

[56] References Cited

U.S. PATENT DOCUMENTS

| | | | |
|---|---|---|---|
| 2,400,849 | 3/1946 | Stearns | 200/67 G |
| 2,831,082 | 4/1958 | Mason | 200/68 |
| 3,072,757 | 1/1963 | Gluck | 200/16 D |
| 3,165,604 | 1/1965 | Sorenson | 200/67 C |
| 3,674,953 | 4/1972 | Brevick | 200/16 C |
| 3,701,870 | 10/1972 | Sorenson | 200/67 G X |
| 3,867,601 | 2/1975 | Lipshutz | 200/16 D |

FOREIGN PATENT DOCUMENTS

| | | | |
|---|---|---|---|
| 487261 | 11/1953 | Italy | 200/67 G |

*Primary Examiner*—J. V. Truhe
*Assistant Examiner*—M. Paschall
*Attorney, Agent, or Firm*—Cushman, Darby & Cushman

[57] ABSTRACT

The present invention provides an electric switch having a mechanism comprising an actuator, a contact member capable of being moved along a path by the actuator and two spaced apart electric contacts arranged along said path; wherein one of said contacts functions, in use, as a fulcrum and wherein said member is so shaped and the switch is constructed and arranged such that said member is moveable, from a first position in which it is in contact with said contacts, slideably with respect to said contacts and in so doing initially rotates in one direction and thereafter pivots about the fulcrum in a rotation of opposite direction whereby to come out of contact with the other of said contacts.

The above can be applied to a host of switches including those with arcuately, linearly and rotary moveable actuators.

27 Claims, 21 Drawing Figures

ELECTRIC SWITCHES

This is a continuation of application Ser. No. 634,177 filed Nov. 21, 1975, now abandoned.

BACKGROUND OF THE INVENTION

FIELD OF THE INVENTION

This invention relates to electric switches. It also relates to contact bridging members for electric switches.

SUMMARY OF THE INVENTION

The present invention provides an electric switch having a mechanism comprising an actuator, a contact member capable of being moved along a path by the actuator and two spaced apart electric contacts arranged along said path; wherein one of said contacts functions, in use, as a fulcrum and wherein said member is so shaped and the switch is constructed and arranged such that said member is moveable, from a first position in which it is in contact with said contacts, slideably with respect to said contacts and in so doing initially rotates in one direction and thereafter pivots about the fulcrum in a rotation of opposite direction whereby to come out of contact with the other of said contacts.

The switch can comprise a number of such mechanisms which are preferably located side by side (although they could be located in line or one above the other) and which share a common operator adapted to operate the actuator of each individual mechanism. Such a switch is able to achieve a number of relatively complex circuits without being unduly expensive.

In another aspect this invention provides an electric switch having a mechanism comprising a contact bridging member, two spaced apart contacts having surfaces adapted to be contacted by said member; said surfaces lying on a surface and said contacts adjacent said surfaces lying on one side of said surface, wherein in one position of the mechanism said member extends between said contacts and contacts said surfaces, wherein said member has portions which, in said one position, are inclined to said surface and away therefrom towards the other side thereof and each of which portions contacts a respective one of said contacts and wherein an intermediate portion of said member, in said one position lies to said one side of said surface; means biasing said member, at said intermediate portion, to lie on said one side of said surface, and an actuator adapted to slide said member relative to said contacts; and constructed and arranged such that said member is slideable with respect to said contacts by said actuator from said one position and in so sliding to move said intermediate portion towards said surface against said biasing means tending to resist such movement.

The above described arrangement and certain other arrangements in accordance with this invention, stabilizes the location of said member.

It is preferred that the length of said member is at least twice that of the spacing of said contacts.

The above described arrangements have advantages other than in stabilizing said member and enables a whole host of special purpose switches to be made.

It is to be noted that said means biasing said member can be adapted to conduct current to or from said member.

Accordingly, in another aspect, this invention provides an electric switch having a mechanism comprising a contact bridging member, three contacts spaced along and defining a path to be traversed by said member; the intermediate contact comprising a fulcrum extending transverse to said path and with the other two of said contacts defining the path to have two portions making an angle of 180° or less with one another; said contact member having a length greater than the spacing apart of said other two of said contacts and having end portions which are inclined away from said path and which can contact two adjacent said contacts, means biasing said member towards the path at a point intermediate said end portions, and an actuator adapted to move said member along said path; and constructed and arranged such that said member is moveable along said path slideably with respect to two adjacent said contacts when in contact therewith and said point is intermediate said any two adjacent said contacts, and constructed and arranged such that in so sliding the means biasing said member acts to cause the trailing end to approach said path and the leading end to move away from said path whereby to be out of contact with the other of said contacts and said member is pivotable about said fulcrum when said point is intermediate said fulcrum and said other of said contacts whereby to come into contact with said other of said contacts.

In the above arrangement it will be realized that said member can be likened to a boat lying in a trough between wave crests (adjacent contacts) rising up at its leading end and lowering at its trailing end in passing over the middle crest (the fulcrum) and then sliding down into the next trough (the space between the fulcrum and the other contact). This movement of the boat enables very positive making and breaking contact.

Further it is to be particularly noted that this arrangement can be applied to an indefinite number of contacts which may define an arcuate or circular path with said member within the arc or circle.

A large number of other arrangements are possible when the contacts lie in a plane and instances include application in rocker switches, push-pull switches, sliding switches and rotary switches.

In a modification, the leading end of said member, in moving away from the path, contacts a body which will exert a force on the leading end until such time as said point passes the fulcrum. This may assist operation.

Said member may take various shapes but it is preferred that it is arcuate or has a flat middle portion with upturned end portions.

In another aspect this invention provides and electric switch having a mechanism comprising a contact bridging member four contacts spaced along and defining a path to be traversed by said member; two of said contacts each comprising a fulcrum extending transverse to said path and intermediate the other two of said contacts and the fulcrums and said other two of said contacts defining said path to have an intermediate portion and two end portions each making an angle of greater than 180° with said intermediate portion; means biasing said member towards the path at a point intermediate its ends, and an actuator adapted to move said member along said path; and constructed and arranged such that said member is moveable along said path slideably with respect to any two adjacent said contacts when in contact therewith and said point is intermediate said any two adjacent said contacts, and said member is pivotable about a respective one of the fulcrums when in contact therewith and said point is intermediate said respective one of the fulcrums and another of said contacts adjacent thereto with respect to which said member is out of contact whereby to come into contact with said another of said contacts.

Said member may be flat but it is preferred that said member is shaped to have portions which are inclined away from said path and which inclined portions contact any two adjacent said contacts when said member is located therebetween. This arrangement results in a more stable location of said fulcrums, than if said member was flat. In one aspect of this, said member is arcuate and in another aspect said member comprises a flat intermediate portion and flat ends which are inclined to said flat intermediate portion and in these aspects the stability of location will be dependent on the shape of the arc and in particular the radius thereof if the arc is an arc of a circle or on the angles that the flat ends make with said flat intermediate portion.

As an alternative, or preferably additional, means of stabilizing the location of said member, particularly when in contact with both of said fulcrums, a cam and a cam follower may be provided, one of which is carried by the actuator and the other of which is carried by a casing for the switch. This use of a cam and cam follower is applicable in other aspects of this invention.

The above defined mechanism has three positions and is particularly useful in a switch intended to have a "centre-off" position.

A particular advantage achievable as a result of this invention is that by chosing the shape of said member and the positioning of the contacts which it contacts it will generally be found to be possible to comply with standards set by electric approval authorities concerning minimum spacings of electrical conductors. In this respect, it is well known that many prior art switches tend to arc immediately before metal parts come into actual contact but with certain switches in accordance with this invention there is a component of motion of said member away from a contact at the same time that it is being brought to a position from which it can pivot from being relatively remote from that contact, and this not particularly prone to arcing, to actually contact that contact. In certain constructions it has been found possible to achieve a minimum of a 3mm. gap at all times except when said member is actually engaged in pivoting about the, or one of the, fulcrums.

Another advantage, of course, lies in the indexing that said member can give.

Still other advantages result from the large variety of switches that can be made.

Further advantages arise from the fact that said member itself is quite inexpensive and other parts used in switches incorporating it are simple and also inexpensive.

Still further, assembly of switches in accordance with this invention has not, in general, be found to be difficult.

Another advangtage is that although a large variety of switches can be made, many of them can be designed to use parts common to other switches and thus economies are achieved.

Still further, rigorous testing of switches in accordance with this invention has shown them to compare very favourably with prior art switches in respect to switch life and arcing problems.

Various aspects of this invention will now be exemplified with the aid of the accompanying drawings.

DETAILED DESCRIPTION

Figure 1:
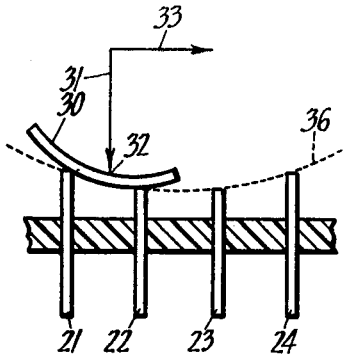
FIG. 1 is a schematic elevational view of one switch mechanism which is useful in certain aspects of this invention.

The mechanism schematically shown in FIG. 1 comprises four contacts (21, 22, 23 and 24) and of them the upper ends of contacts 22 and 23 lie in a first plane below a second plane in which lie the upper ends of contacts 21 and 24.

A contact bridging member 30 is provided and is biassed downwardly in the direction of arrow 31 by means which is not shown and which acts on point 32. Bridging member 30 can also be moved in the direction of arrow 33 (and in the reverse direction) by means which also is not shown. As shown in FIG. 1, bridging member 30 bridges contacts 21 and 22.

It is also to be noted that bridging member 30 is curved and that the radius of curvature of the bridging member 30 is less than the radius of a circular arc (indicated by dotted line 36) which intersects the upper ends of contacts 21, 22, 23 and 24.

When bridging member 30 is moved in the direction of arrow 33 it will slide on contacts 21 and 22 and in so doing the right and left hand ends (in FIG. 1) will rotate respectively anti-clockwise and clockwise and respectively rise and fall so that although the right hand end is being moved towards contact 23 it also has a component of motion away from contact 23. This motion proceeds until point 32 passes contact 22 whereupon the bias in the direction of arrow 31 will cause the bridging member 30 to pivot about contact 22 with contra-rotation of the ends of member 30 to those rotations described above so that the right hand end comes into contact with contact 23 and the left hand end comes out of contact with contact 21 and so that contacts 22 and 23 are bridged. Continued movement in the direction of arrow 33 will cause contacts 23 and 24 to be bridged and contact with contact 22 to be broken.

The effect of the bias on point 32 will be discussed in respect of FIGS. 2–4.

The mechanism shown in FIG. 1 is particularly effective as a centre-off switch when contacts 22 and 23 are active and has a position on each side of centre in which current will flow to contact 21 or 24.

Other arrangements of the mechanism shown in FIG. 1 that are particularly desirable are those where a number of such mechanisms are arranged side-by-side to be operated by a common operator. An example of this is that the circuit of FIG. 18 (to be discussed in detail later) can be achieved.

Figure 2:
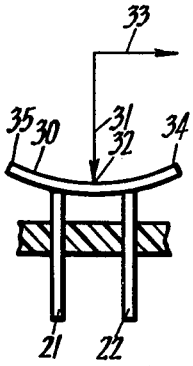
FIGS. 2–4 are a schematic elevational view of another switch mechanism which is useful in certain aspects of this invention and show the mechanism in various stages of operation.
Figure 3:
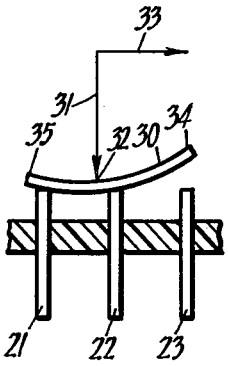
Figure 4:
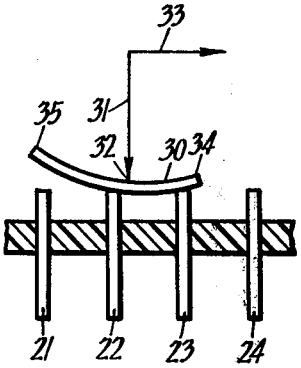

In the mechanism shown in FIGS. 2–4 like integers are represented by the same reference numerals as used in respect of FIG. 1. It is to be noted that FIGS. 2–4 have been drawn to show stages in the operation of the mechanism; the whole mechanism being schematically shown in FIG. 4. It is to be noted also that the upper ends of contacts 21, 22, 23 and 24 all lie in one and the same plane.

The manner of operation of the mechanism shown in FIGS. 2–4 is similar to that of FIG. 1 but is set out below.

From the position shown in FIG. 2 with bridging member 30 evenly located between contacts 21 and 22 it is moveable to the right in the direction of arrow 33. In so moving, bridging member 30 slides on contacts 21 and 22, rotates as described with respect to FIG. 1 and it is to be noted that point 32 moves from initially below the aforesaid plane and rises to the level of the aforesaid plane against the bias which tends to act against such movement.

The bias also, while point 32 is between contacts 21 and 22, will cause end 35 of the bridging member 30 to approach the aforesaid plane and, in the sliding, end 34 is, as a consequence, caused to rise further above the aforesaid plane until the position shown in FIG. 3 is reached when end 34 is above but not in contact with contact 23.

This being above but not in contact with contact 23 is considered highly desirable as there is little prospect of arcing but switching can be rapidly effected.

Continued movement in the direction of arrow 33 will cause point 32 to pass contact 22 whereupon the bias will cause end 34 to fall (see FIG. 4) to contact contact 23 and end 35 will rise to break contact with contact 21.

Thus, as shown in FIGS. 2–4, (the mechanism of FIG. 1, as mentioned before, operates similarly), the bridging member 30 is akin to a boat rising up on crests and descending into troughs with its leading end rising to locate above each crest before falling to contact that crest.

As mentioned, FIGS. 1 and 2–4 are schematic and it will be realized that an enormous number of switches can be made which embody those mechanism and without wishing to be restricted applicant mentions rocker, sliding and rotary switches all of which can come in various forms.

As further exemplification applicant mentions that the mechanism of FIG. 1 can be applied to simple rocker switches having three or more contacts or to rotary switches having a plurality of contacts (for instance 6, 12, 14, 18 or 24) which extend radially, which define a circular path, and which have axially extending surfaces which are contacted by bridging member 30.

The mechanism of FIGS. 2–4 is considered by applicant to be particularly meritorious as sliding switches of any length can be made and also rotary switches can also be made.

Figure 5:
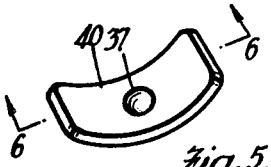
FIG. 5 is a perspective view of a contact bridging member which is useful in certain aspects of this invention.
Figure 6:
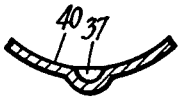
FIG. 6 is a sectional view on line 6—6 in FIG. 5.
Figure 8:
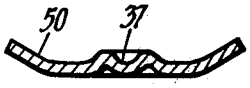
FIG. 8 is a sectional view of another contact bridging member which is useful in certain aspects of this invention.

The contact bridging members shown in FIGS. 5 and 6, and FIG. 8 are specific examples of contact bridging members which can be used in the mechanism of FIGS. 1 and 2–4.

Figure 7:
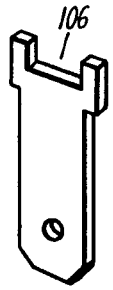
FIG. 7 is a perspective view of an electrical contact which is useful in certain aspects of this invention.

The contact bridging member 40 shown in FIGS. 5 and 6 is curved along its length and has a dunk 37 in one side with a corresponding projection on the other side. Because of that projection the member 40 needs to be used with contacts having a slot 106 therein, such as is shown in FIG. 7.

The contact bridging member 50 shown in FIG. 8 has a flat intermediate portion and two flat end portions which are upwardly inclined to the intermediate portion. The member 50 also has a dunk 37 but it is formed in a bossed up portion so that there is no projection below the plane of the lower surface of the intermediate portion.

Figure 19:
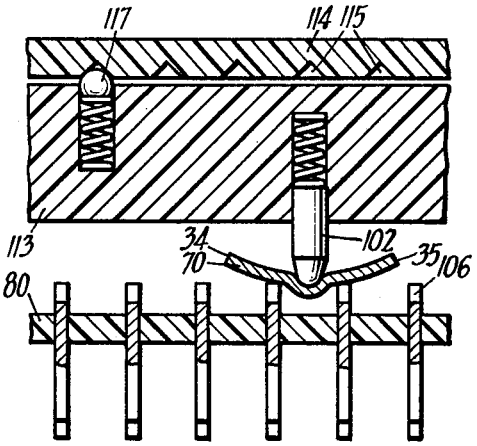
FIG. 19 is a developed cross-sectional view of the switch of FIG. 16.
Figure 17:
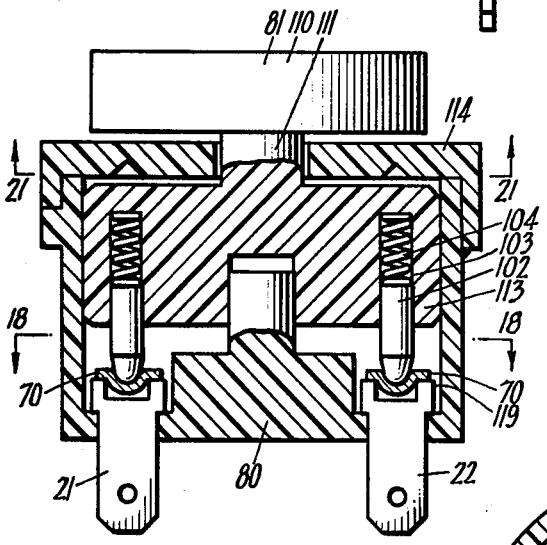
FIG. 17 is a cross-sectional view on line 17—17 in FIG. 16.
Figure 20:
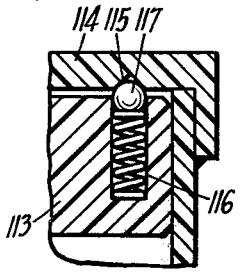
FIG. 20 is a cross-sectional detail of the switch of FIG. 16.
Figure 21:
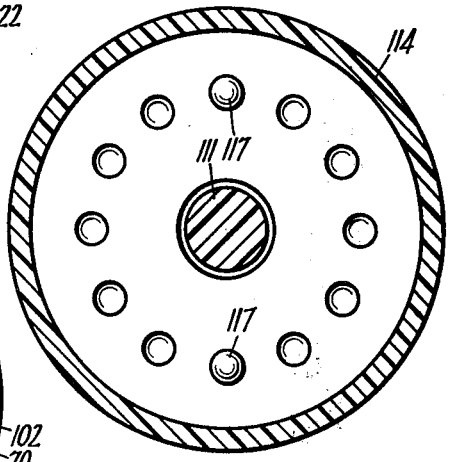
FIG. 21 is a cross-section on line 21—21 in FIG. 17.
Figure 18:
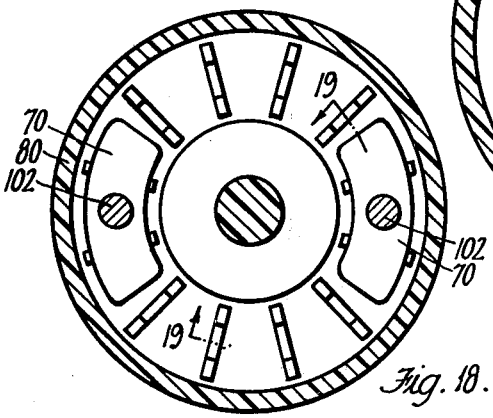
FIG. 18 is a cross-sectional view on line 18—18 in FIG. 17.

Another bridging member which is particularly useful for rotary switches is the member 70 which can be seen in plan in FIG. 18 wherein it is seen to be curved, and in vertical cross-section in FIG. 19, wherein it is seen to also be arcuate in respect of that view.

An example of a switch mechanism embodying the mechanism of FIG. 3 is shown schematically in FIGS. 9 and 10 and once again like reference numerals denote like integers excepting that it is to be noted that a further contact 25 is provided, bridging member 30 is dish shaped and has a dunk 37 in its centre which serves as a locant for means for biassing it in the direction of arrow 31, and a linearly extending contact 26 is also provided.

Figure 9:
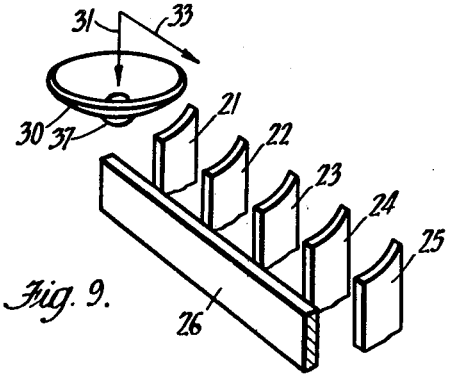
FIG. 9 is a schematic exploded perspective view of another switch mechanism in accordance with this invention.
Figure 10:
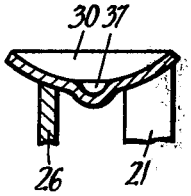
FIG. 10 is a cross-section of the mechanism shown in FIG. 9.
Figure 11:
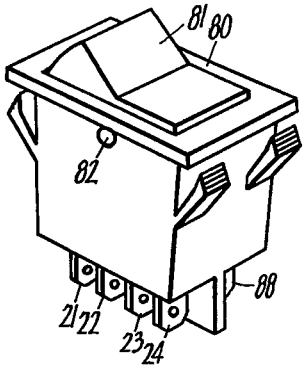
FIG. 11 is a perspective view of a specific switch in accordance with this invention which embodies the mechanism of FIG. 1 but which is modifiable, to have a mechanism inter alia as shown in FIGS. 2–4.

In the arrangement shown in FIGS. 9 and 10 the bridging member 30 makes sliding contact at all times with contact 26 and engages contacts 21–25 in like manner as described with respect to FIGS. 2–4. Thus, at any one time, a circuit is established between contact 26 and any two adjacent ones of contacts 21–25.

A variant on the switch mechanism shown in FIGS. 9 and 10 has contacts equivalent to 21–25 which have concave upper surfaces arranged at right angles to the concave surfaces shown in FIG. 9 so that, as well as forming circuits between contact 26 and any two adjacent ones of contacts 21–25 in a similar manner as described with respect to FIGS. 9 and 10, it is also possible to form circuits between contact 26 and any one of contacts 21–25.

The arrangements shown in FIGS. 9 and 10 and the variant thereon are particularly suitable for use in rotary switches in that if contact 26 is made into an annulus and additional contacts like 21–25 are provided and arranged in a circle the switch is converted from being linear to rotary.

The specific switch in accordance with this invention which is shown in FIGS. 11–14 uses the mechanism of FIG. 1. As before, like reference numerals denote like integers.

Figure 14:
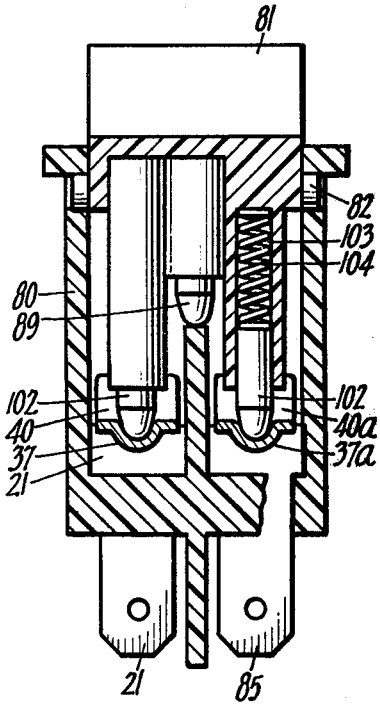
FIG. 14 is another cross-section through the switch of FIG. 11 and is a view on line 14—14 in FIG. 13.

The switch comprises a body 80 in which an operator 81 is pivotally mounted by means of pivot pins 82. The body carries contacts 21–24 and it is to be noted that contacts 21 and 24 lie at a higher level than contacts 22 and 23. The body also has contacts 85, 86, 87 and 88 which lie behind, respectively, contacts 21, 22, 23 and 24 in FIG. 10 and one of which, 85, is shown in FIG. 14.

Operator 81 is provided with a pin 89 which is slideably received in a bore 92 and is spring loaded by a spring 94. The pin 89 follows a cam surface 97 formed on an intermediate wall in the body 80 and co-operates with a depression 99 in that cam surface to stabilize the operator 81 when it is in a central position.

The bridging member used in this instance for contacts 21–24 is the member 40 shown in FIGS. 5 and 6 and it is to be noted that it has the dunk 37 in its centre which accommodates a pin 102 carried in a bore 103 in operator 81 and which pin 102 is spring loaded by a spring 104. The bridging member for contacts 21–24 is of the same shape and is identified by reference numeral **40*a*. It, too, has a dunk 37*a* equivalent to 37** for a similar reason.

To enable dunks 37 and **37*a* to pass, contacts 22, 23, 6 and 87 are slotted at 106 as is best seen in FIG. 7**.

The manner of operation of the switch shown in FIGS. 11–14 is essentially the same as that of the mechanism shown in FIG. 1 and it will not be further explained excepting that it is to be noted that pin 102 exerts the bias in the direction of arrow 32 mentioned in claim 1 and enables movement in the direction of arrow 33 and the opposite direction.

The switch shown in FIGS. 11–14 can be used in a progressive circuit which hitherto has only been achievable at great expense. That circuit is shown in FIG. 15 where each of contacts 21–24 and 85–88 is represented by a circle, A" means active or line supply and is connected to contacts 21, 24 and 87 and lines under "40" and "**40*a***" indicate circuit conditions with an arrow indicating current passing and a dash line indicating no current passing.

Figure 15:
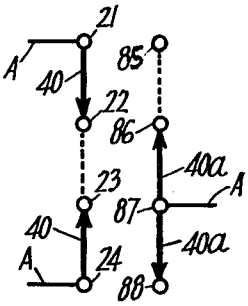
FIG. 15 is a schematic drawing exemplifying one manner of use of the switch shown in FIGS. 11–14.
Figure 16:
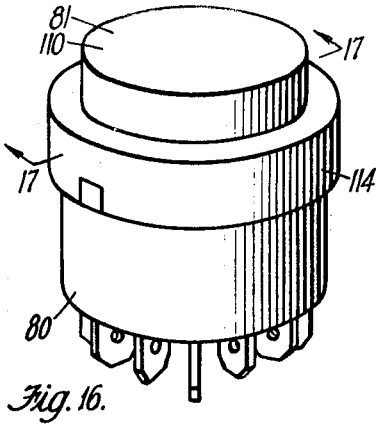
FIG. 16 is a perspective view of another specific switch in accordance with this invention which embodies the mechanism of FIGS. 2–4.

The switch of FIGS. 11–14 in the circuit shown in FIG. 15 acts as a progressive switch and in a first position (the position shown in FIG. 13) current flows between contacts 21 to 22 but not between contacts 85 and 86.

In a second (central) position, current does not flow between contacts 22 and 23 but does flow between contacts 86 and 87. In a third position (bridging members 40 and **40*a* in contact with, respectively, contacts 23 and 24, and 87 and 88) current flows between contacts 23 and 24, and 87 and 88**.

The switch shown in FIGS. 11–14 can be modified to operate as does the mechanism of FIGS. 2–4 if all contacts lie in the same plane but this is not preferred as operator 81 causes pins 102 to move arcuately.

The switch shown in FIGS. 11–14 can also be modified by omitting contacts 22 and 23, and 86 and 87 and by inserting a contact in groove **100*b* (and a corresponding contact in a corresponding groove with respect to bridging member 40*a*). When so modified the switch becomes a two position switch and in this instance the pin 89 is best omitted. Grooves 100*a* and 100*c*** can be used to receive other contacts to thus enable different switching operations.

The switch shown in FIGS. 16–21 is an application of the mechanism shown in FIGS. 2–4 and parts similar to those of FIGS. 2–4 and 11–14 bear like reference numerals.

The switch shown in FIGS. 16–21 has a body 80, an operator 81 which comprises a knob 110 and a shaft which passes through a cover 113 and which carries a block 113. The block is also supported by a post arising within the body 80.

The cover 114 for the body 80 has a series of indentations 115 arranged in a circle on its inner surface. The block 113 has two bores 116 arranged diametrically opposite one another and the bores locate spring loaded balls 117 which serve to locate block 113 in any one of twelve different angular orientations.

The body 113 has twelve contacts therein which are similar in form to the contacts of the switch shown in FIGS. 11–14 (see also FIG. 7) but which are arranged in a circle with their upper ends 119 extending radially and in a plane. Only two of those contacts (21 and 22) are specifically numbered.

As a bridging member is used the member 70 previously mentioned and a similar member identified by **70*a*. It is to be noted that as well as being arcuate when seen in cross-section (see FIG. 19) in a similar manner to contact 40, bridging members 70 and 70*a* are also arcuate when seen in plane (see FIG. 18**).

Block 113 carries pins 102 in holes 103 and the pins 102 are spring loaded by springs 104.

Figure 12:
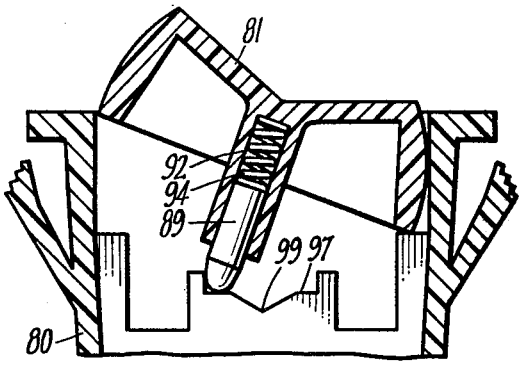
FIG. 12 is a cross-section through the switch of FIG. 11.
Figure 13:
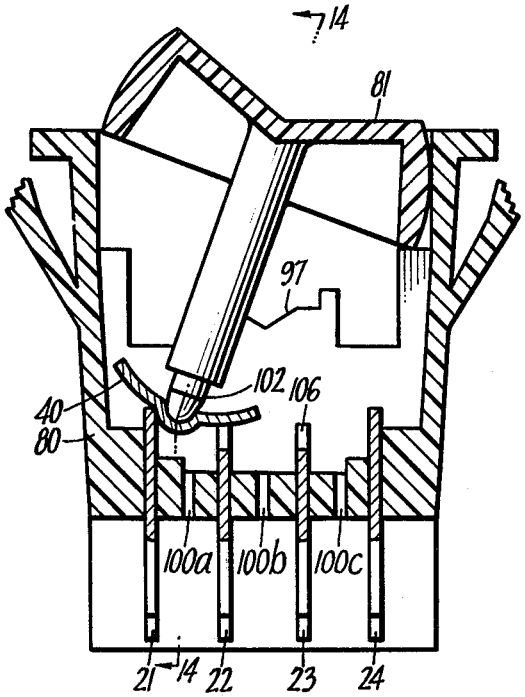
FIG. 13 is another cross-section through the switch of FIG. 11.

It is not considered necessary to describe the operation of the switch shown in FIGS. 12 and 13; the manner of operation being similar to the mechanism shown in FIGS. 2–4 with the exception that bridging members move in a circular rather than a linear path. However, it is also to be noted that ends 34 and 35 of bridging members 70 and **70*a* contact the underside of block 113 and that this is believed to aid the operation in that a strong downward bias is exerted as pins 102** pass each of the contacts.

The switch shown in FIGS. 12 and 13 is a double pole twelve positions switch. It operates in an excellent manner and is extremely cheap to manufacture.

In some constructions in accordance with FIGS. 16–21 it is desirable that pins 102 are electrically conducting and that current is supplied thereto.

In a particular construction in accordance with FIGS. 11–14 all contacts are 1mm. thick, contacts 21 and 22 and 23 and 24 are spaced about 6.5 or 5.5mm. apart and contacts 22 and 23 are spaced about 6.5, 6.0 or 5.5 mm. apart. (Spaces between adjacent surfaces, not centres). The upper surfaces of contacts 22 and 23 lie in a plane spaced 2.12mm. from a plane including the upper surfaces of contacts 21 and 24 and the distance from pin 82 to the upper surface of contact 22 is 41 mm. The radius of outside curvature of contact bridging member 40 is 0.359 inch (about 9mm.) and its chord length is about 15mm. and thus the arc subtended is about 80° and has a length of about 20mm.

In general, for constructions such as is shown in FIGS. 11–14, it is preferred that the radius of curvature of the bridging member is from 1/5th to 2/3rds, preferably 1/4th to 1/3rd, radius of movement of the end of the operator. For constructions in which the contacts lie in plane it is preferred that the radius of curvature of the bridging member is from equal to or greater than the spacing of the contacts and preferably is no more than 4 times the spacing.

In general, the curvature of the bridging member should be such as to give the indexing required, or if this is not particularly required, must be at least such as will allow it to pass from contact to contact having regard to the particular disposition of the contacts; thus for contacts with ends lying on a circle as in FIGS. 11–14 the radius of curvature of the contact bridging member need to be greater than when they lie all in one plane. Further, consideration should be had to electric approval authorities regulations some of which require a minimum 3mm. gap under certain circumstances; and it is mentioned in this respect that the location of end 34 above but not in contact with contact 23 mentioned in respect of FIGS. 2–4 is easily achievable to the extent of a 3mm. spacing.

In modifications of the constructions above described the contacts may have enlarged contact surfaces, such as by bending them, to provide greater areas for contact.

In the specific constructions described above all of the contact bridging members have the dunk 37 and corresponding projection on the other side of the contact bridging members and use contacts with slots 106 as shown in FIG. 7. While effective for many purposes, these slotted contacts do not have the current load carrying capacity of plain ended contacts, tend to promote arcing and seem to result in decreased switch life. If desired, alternatives such as the contact bridging members and terminals shown in copending Australian Patent Application No. PB 9857, a divisional thereof and corresponding applications in countries foreign to Australia filed by same applicant and being Application Nos. may be used.

Modifications and adaptions may be made to the constructions disclosed herein without departing from the spirit and scope of this invention which includes every novel feature and combination of features disclosed herein.

The claims form part of the disclosure of this specification.

I claim:

1. An electric switch having a mechanism comprising a contact bridging member, two spaced apart contacts having surfaces adapted to be contacted by said member; said surfaces lying on a surface and said contacts adjacent said surfaces lying on one side of said surface, wherein said member has portions which, in said one position, are inclined to said surface and away therefrom towards the other side thereof and each of which portions mechanically and electrically contacts a respective one of said contacts and wherein an intermediate portion of said member, in said one position lies to said one side of said surface; means biasing said member, at said intermediate portion, to lie on said one side of said surface, and an actuator adapted to slide said member relative to said contacts; and constructed and arranged such that said member is slideable with respect to said contacts by said actuator from said one position and in so sliding to move said intermediate portion towards said surface against said biasing means tending to resist such movement.

2. An electric switch as claimed in claim 1, wherein the length of said member is at least twice that of the spacing of said contacts.

3. An electric switch having a mechanism comprising a contact bridging member, three contacts spaced along and defining a path to be traversed by said member; the intermediate contact comprising a fulcrum extending transverse to said path and with the other two of said contacts defining the path to have two portions making an angle opening away from said contacts 180° or less with one another; said contact member having a length greater than the spacing apart of said other two of said contacts and having end portions which are inclined away from said path and which adapted to mechanically and electrically contact two adjacent said contacts, means biasing said member towards the path at a point intermediate said end portions, and an actuator adapted to move said member along said path; and constructed and arranged such that said member is moveable along said path slideably with respect to two adjacent said contacts when in contact therewith and said point is intermediate said any two adjacent said contacts, and constructed and arranged such that in so sliding the means biasing said member acts to cause the trailing end to approach said path and the leading end to move away from said path whereby to be out of contact with the other of said contacts and said member is pivotable about said fulcrum when said point is intermediate said fulcrum and said other of said contacts whereby to come into contact with said other of said contacts.

4. An electric switch as claimed in claim 3, wherein, in moving along said path, the leading end of said member contacts a body adapted to exert a force thereon until the member pivots about the fulcrum.

5. An electric switch as claimed in claim 3 or, wherein said contacts lie in a plane.

6. An electric switch as claimed in claim 3, wherein said contacts lie on an imaginary curved surface and said member has a curvature greater than that of said surface.

7. An electric switch as claimed in claim 3 wherein said contacts lie in a plane.

8. A rotary switch incorporating a mechanism as defined in claim 3.

9. An electrical switch as claimed in claim 3 and so contructed that, immediately preceding said member pivotting about the fulcrum, one of the contacts adjacent the fulcrum and with which said member is out of contact is spaced from said member a distance being at least the minimum required by electrics approval authorities; for instance, 3mm. or more.

10. An electrical switch as claimed in claim 3 and including a cam and a cam follower operative in use to stabilize said member in predetermined positions.

11. An electrical switch as claimed in claim 3, wherein said means biasing said member is adapted to conduct current to or from said member.

12. An electric switch having a mechanism comprising a contact bridging member, four contacts spaced along and defining a path to be traversed by said member; two of said contacts each comprising a fulcrum extending transverse to said path and intermediate the other two of said contacts and the fulcrums and said other two of said contacts defining said path to have an intermediate portion and two end portions each making an angle of greater than 180° with said intermediate portion defining said path as a curve opening towards said contacts; means biasing said member towards the path at a point intermediate its ends, and an actuator adapted to move said member along said path; and constructed and arranged such that said member is moveable along said path slideably with respect to any two adjacent said contacts when in contact therewith and said point is intermediate said any two adjacent said contacts, and said member is pivotable about a respective one of the fulcrums when in contact therewith and said point is intermediate said respective one of the fulcrums and another of said contacts adjacent thereto with respect to which said member is out of contact whereby to come into contact with said another of said contacts.

13. An electric switch having
a mechanism comprising
an actuator,
a contact bridging member capable of being moved along a path by the actuator, and
two spaced apart electric contacts arranged along said path
and wherein
one of said contacts functions, in use, as a fulcrum
the actuator applies force to said member at an area intermediate its ends and on one side thereof,
said member has an opposite side which, in use, contacts said contacts,
said opposite side being comprised of first and second surface portions which are at an angle to one another diverging from said path
and which surface portions, in a first position of said member, mechanically and electrically contact respective ones of said contacts are inclined to a straight line joining surfaces of said contacts which are contacted by said member when in said first position and said area is located to the side of said fulcrum adjacent the other of said contacts whereby to closely nest part of said member with and between said contacts,
said force is applied in a direction urging said part into such nesting relation
and wherein said member is so shaped and located and the switch is constructed and arranged such that said member is movable,
from said first position,
slideably with respect to said contacts and in so doing
the trailing one of said surface portions moves with a component of motion in said direction of said force such that said member initially rotates in one direction,
said part moves to become relatively less nested and does so against said force tending to restore it to the nested condition,
said area approaches said fulcrum, and
thereafter after said area has passed the fulcrum pivots about the fulcrum in a rotation of opposite direction whereby to come out of contact with the other of said contacts.

14. An electric switch as claimed in claim 13, wherein said opposite side has an arcuate shape.

15. An electric switch as claimed in claim 13, wherein said opposite side has two end portions and a portion intermediate the two end portions and wherein the end portions are inclined to the intermediate portion.

16. An electric switch as claimed in claim 13, wherein said fulcrum is defined by an edge of a strip of metal.

17. An electric switch as claimed in claim 13, wherein the actuator is linearly reciprocable.

18. An electric switch as claimed in claim 13, and including a third electric contact to the side of the fulcrum opposite to the second electric contact and with which third electric contact the leading end of the contact bridging member is brought into contact in consequence of the aforesaid pivoting.

19. An electric switch as claimed in claim 13, wherein the length of said contact bridging member is at least twice that of the spacing adjacent said contacts.

20. An electric switch as claimed in claim 13, wherein in moving along said path, the leading end of said contact bridging member contacts a body adapted to exert a force thereon until the member pivots about the fulcrum.

21. An electric switch as claimed in claim 13, wherein said contacts lie in a plane.

22. An electric switch as claimed in claim 13, wherein said contacts lie on an imaginary convexedly curved surface opening towards said actuator and said contact bridging member has a curvature greater than that of said surface.

23. A rotary switch incorporating a mechanism as defined in claim 13.

24. An electric switch as claimed in claim 13, including another such switch mechanism.

25. An electric switch as claimed in claim 3, further including a second mechanism which replicates the first-described mechanism, but shares said actuator therewith whereby both mechanisms may be operated in common by said actuator.

26. An electric switch of the type including an actuator, a contact bridging member cooperating with said actuator and adapted for translational movement responsive to said actuator along a predetermined path, and a plurality of contacts disposed having surfaces along said path to slidably engage one surface of said bridging member opposite said actuator,
said path defines a curve opening towards said actuator having a predetermined radius of curvature and, said bridging element one surface is shaped in accordance with a curve having a radius of curvature less than said predetermined path radius of curvature, whereby fulcrum operation as between respective contacts along said path can be effected.

27. The switch of claim 26 wherein said path predetermined radius is effectively infinite whereby said path is a straight line.

* * * * *